PM011 XR 3,936,789

United States Patent [19]

Matzen et al.

[11] 3,936,789

[45] Feb. 3, 1976

[54] SPREADING RESISTANCE THERMISTOR

[75] Inventors: Walter T. Matzen; Don L. Kendall, both of Richardson, Tex.

[73] Assignee: Texas Instruments Incorporated, Dallas, Tex.

[22] Filed: June 3, 1974

[21] Appl. No.: 475,712

[52] U.S. Cl. ..... 338/22 SD; 357/28

[51] Int. Cl.[2] ..... H01C 7/04

[58] Field of Search ..... 338/22 R, 22 SD, 25; 357/28, 51, 91

[56] References Cited

UNITED STATES PATENTS

| | | | |
|---|---|---|---|
| 2,953,759 | 9/1960 | Lehovec | 357/28 |
| 3,406,366 | 10/1968 | Kontrimas et al. | 357/28 |
| 3,453,498 | 7/1969 | Hubner | 357/51 X |
| 3,488,564 | 1/1970 | Crafts | 357/51 X |
| 3,491,325 | 1/1970 | Shih-MingHu | 338/22 R |
| 3,548,269 | 12/1970 | Macdougall et al. | 357/28 |
| 3,700,977 | 10/1972 | Lunn | 357/51 |
| 3,710,207 | 1/1973 | Chafghaichi et al. | 357/51 |
| 3,729,662 | 4/1973 | Langdon | 357/51 |

*Primary Examiner*—C. L. Albritton

*Attorney, Agent, or Firm*—Harold Levine; James T. Comfort; Gary C. Honeycutt

[57] ABSTRACT

A spreading-resistance silicon thermistor having high-precision values of resistance and temperature coefficient of resistance (TCR) is produced by a high-volume, low-cost, photolithographic technique, wherein multiple thin-film contacts are tested and selectively trimmed to permit computerized control of precision resistance values in a production-line operation.

4 Claims, 6 Drawing Figures

SPREADING RESISTANCE THERMISTOR

Figure 1:
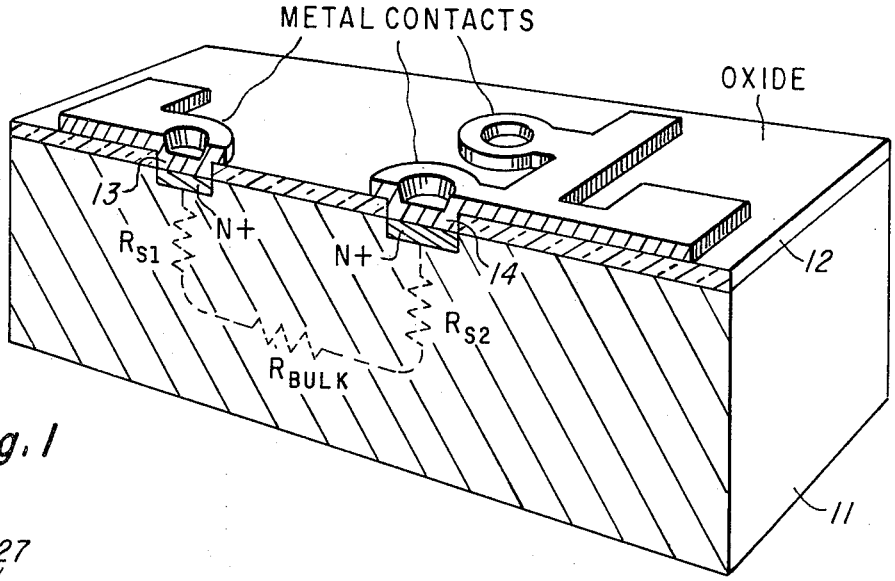

This invention relates to the manufacture of precision resistance devices, and more particularly to the fabrication of a spreading-resistance resistor or "thermistor" having high precision values of resistance and/or temperature coefficient of resistance (TCR). A high-volume, low-cost photolithographic processing technique is provided, wherein multiple thin-film contacts are tested and selectively trimmed to permit computerized control of precision resistance values in a producton-line operation.

Frequently, a thermistor is defined as having a negative temperature coefficient of resistance; however, for purposes of this disclosure the term is applied equally to devices having either a positive or a negative temperature coefficient of resistance.

A commercially available silicon thermistor has generally been fabricated by sawing a bar from bulk silicon, and bonding terminals to the ends of the bar, whereby the resistance of the device is determined by the equation:

$$R = \rho L/A$$

where $\rho$ is the resistivity, $L$ is length and $A$ is the cross-sectional area of the bar.

Certain disadvantages are inherent in such a design, since a high resistance device requires a silicon bar which is inconviently large. Moreover, the bar design is not compatible with standard high-volume, low-cost processing and packaging techniques. Still further, the standard device has a resistance tolerance of about ± 15 percent, which is unacceptable for many commercial applications.

The device of the present invention is conceptually quite different from the standard thermistor, since its resistance is controlled by the spreading-resistance of ohmic contacts to bulk silicon, whereby the total resistance of the device is primarily dependent upon the size of such ohmic contacts. The spreading-resistance of circular contacts to the bulk region is:

$$R = \rho/2d$$

where $\rho$ is the bulk resistivity in ohm centimeters and $d$ is the diameter of the contact opening in centimeters.

A slightly different formula applies for square contacts:

$$R \approx \rho/(2s \times 1.13)$$

where $s$ is the length of a side in centimeters.

Total resistance also depends upon ths spacing between the contacts and to some extent upon the thickness of the silicon body; however, these effects may be minimized by the "shunting" of the backside of the silicon chip.

If it were possible to supply a production-line facility with silicon wafers having absolutely uniform resistivity from wafer to wafer, and from place to place across the diameter of each wafer, then a commercially feasible spreading-resistance device could be designed wherein a single input contact and a single output contact would yield a precise, reproducible resistance value. However, the current state of the art does not permit the production of silicon wafers having precisely controlled resistivity from wafer to wafer and from place to place on a single wafer. Accordingly, it is a primary object of the present invention to produce a spreading-resistance thermistor having a contact geometry and placement which enables one to compensate for the lack of uniformity and precision of silicon bulk resistivities.

Thus, in its broadest aspects, the invention is embodied in a process for the fabrication of a precision resistance device beginning with the step of forming a plurality of electrical contacts to a body of resistance material. Then, a plurality of selected combinations of two or more of these contacts are tested by probe contacts to determine which of the various combinations will provide the desired resistance value. Then, anode and cathode terminals are bonded to that combination of contacts which satisfies the specific resistance requirement as determined by the resistance-probe testing. Consequently, it is contemplated that two or more contacts may be electrically connected in common as a single terminal, in combination with one or more other contacts serving as the other terminal of the device.

For convenience, it is generally desirable to provide a first group of contacts, potentially to serve as the anode, and a second group of contacts, potentially to serve as the cathode of a single resistor. In order to achieve the desired resistance, one or more of the first group of contacts will be "discarded" or left unconnected, as determined by the testing procedure; while one or more of the second plurality of contacts will also be left unconnected, as determined by the testing step.

In order to provide still greater flexibility in the selection of a precise resistance value, it is preferred that at least one of the groups include a selected number of contacts having unequal contact areas joined to the body of resistance material. For example, a progression of decreasing contact dimensions which differ from one to the next by about 8 percent has been found advantageous. Of course, still greater flexibility may be achieved by providing both the first and second groups of contacts with a selected number having unequal areas arranged in a similar progression of dimensions differing by the same or similar increments.

In a still more specific embodiment, it has been found desirable to electrically join each contact of one such group to a common bonding pad for the attachment of a device terminal, and then, ater testing, to selectively trim one or more of the metallization paths which connect the contacts to the bonding pad, and thereby retain electrical connection selectively to one or more contacts which provide the desired resistance value, in combination with a single contact selected from the other group of contacts.

Another aspect of the invention is embodied in a device produced by any of the above methods; for example, a two-terminal resistor comprising a body of resistive material having a plurality of spreading-resistance electrical contacts thereto, at least two of which are electrically connected to a single terminal of the device, and at least one of the remaining contacts is connected to the other terminal. Preferably, such a resistor is comprised of a semiconductor wafer covered by an insulating film having apertures therein which define the electrical contact areas, and wherein the contacts are comprised of patterned, thin-film metallization.

In a preferred embodiment such a device includes a bonding pad to which at least two of said thin film contacts are electrically connected, said bonding pad in turn being connected to a single terminal of the resistor.

Figure 2A:
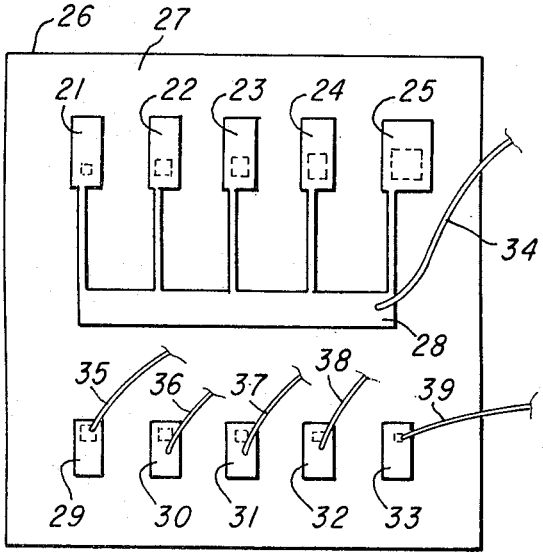
Figure 2B:
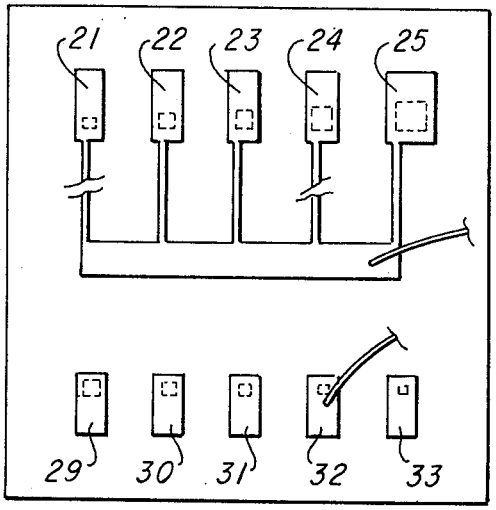
Figure 3A:
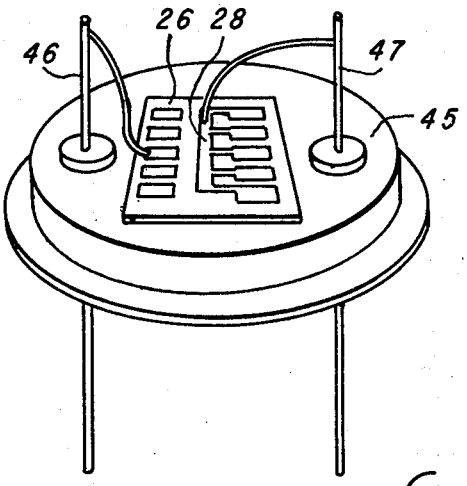
Figure 3B:
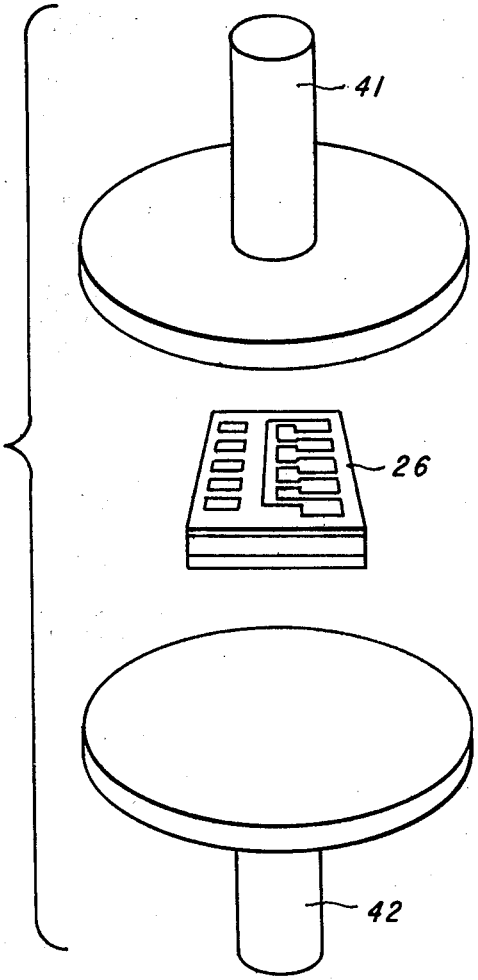
Figure 4:
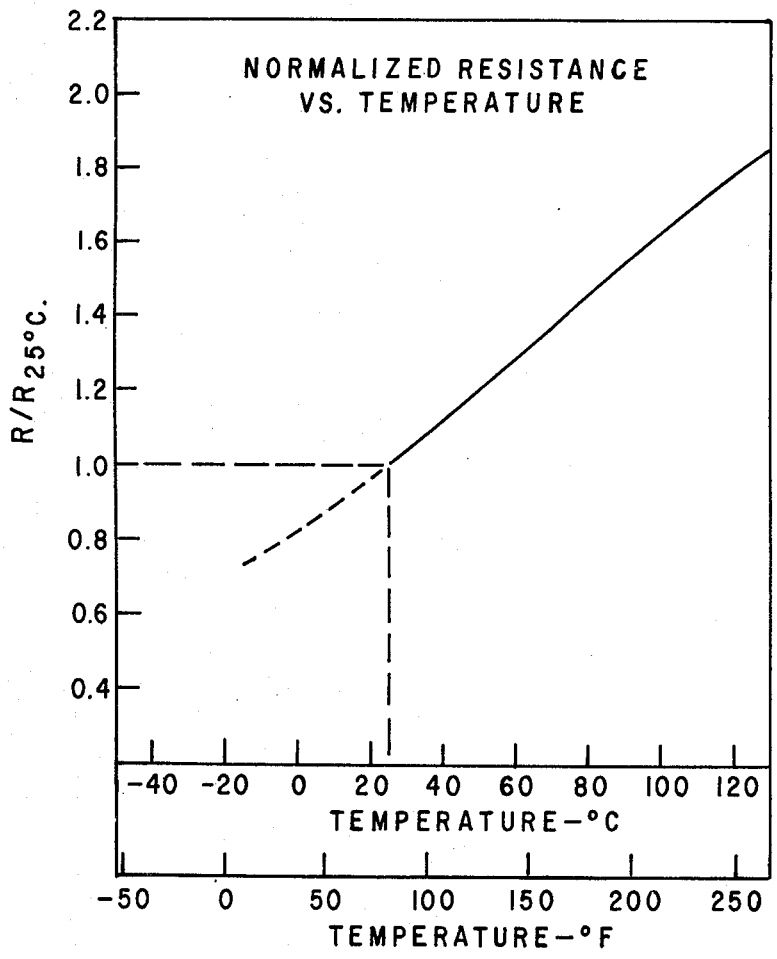

FIG. 1 is a cross-sectional view, partially in perspective, showing the basic geometry and the concept of a spreading-resistance thermistor;

FIG. 2*a* is a top view of a thermistor element or chip in an intermediate stage of fabrication, showing the contact and metallization pattern at the time of resistance-probe testing;

FIG. 2*b* is a top view of the device of FIG. 2*a*, after selective trimming of the metallization which leads from two of the contacts to the central bonding pad;

FIG. 3*a* is a partially assembled perspective view and FIG. 3*b* is an expanded view of one embodiment FIG. 4 is a plot of the normalized resistance-versus-temperature for a thermistor device embodying the invention.

The concept of a spreading-resistance thermistor in its broadest aspects is illustrated by the device of FIG. 1 comprising a silicon body 11 coated with insulation layer 12 having apertures therein defining ohmic contacts 13 and 14, the sizes of which determine their spreading-resistance, such that the total resistance of the device is the sum of the spreading-resistances of the separate contacts, plus a minor bulk resistivity factor. Each contact is made to an n+ enhancement region, as illustrated, for an n-type bulk thermistor, or to an p+ region for a p-type bulk thermistor.

The semiconductor chip illustrated in FIGS. 2*a* and 2*b* measures approximately 50 mils square and is one of several hundred chips obtained from a single silicon slice. Metallization areas 21–25 make electrical contact with n+ regions on chip 26 through apertures in silicon oxide layer 27. Each of contacts 21 through 25 is connected to bonding pad 28 by means of a thin conductor strip extending therebetween as illustrated. The contact aperture dimensions 21–25 are unequal, ranging from ¼ mil square for contact 21, and progressively increasing sequentially up to 4 mils square for contact 25.

Contacts 29–33 similarly consist of thin-film metallization deposited over apertures in oxide layer 27 thereby making electrical contact to n+ regions on chip 26. These contacts also have unequal dimensions ranging from 1.2 mils square at contact 29 down to 0.8 mil by 0.9 mil at contact 33. Note that the stepwise progression from contact 29 and 33 includes increments of about 8 percent from contact to contact, while much larger steps are patterned for contacts 21–25.

A single test probe 34 is then paired in sequence with each of test probes 35–39, thereby permitting calculations to reveal which of contacts 29–33 should be selected for contact to one terminal (anode or cathode) of the packaged device. Similarly, the test data indicates which combination of one or more of contacts 21–25 should be retained in electrical contact with bonding pad 28 for bonding to the other terminal of the packaged device.

FIG. 2*b* shows that contacts 21 and 24 have been selectively trimmed or disconnected from bonding pad 28 by removing a portion of the conductor paths leading thereto. The trimming step may be carried out electrically, mechanically or chemically; however, it is preferred to use a laser beam because of the inherent speed and convenience obtained. Thus, contacts 22, 23 and 25 are retained for electrical connection to one terminal of the packaged device; while contact 31 is selected as the only contact to be electrically connected to the other terminal.

Other variations of contact geometries are also useful. For example, a group of contacts such as 21–25 in FIGS. 2*a* and 2*b* may include a number of contacts having apertures of equal size, alone or in combination with a single contact aperture of much larger dimensions. In the latter embodiment, the large contact would always remain electrically connected to bonding pad 28, while a number of the remaining contacts would be trimmed to adjust the total resistance value.

In FIG. 3*a* chip 26 is mounted on TO-5 header 45. Contact 31 is wire-bonded to terminal 46, while bonding pad 28 is wire-bonded to terminal 47.

In FIG. 3*b*, an alternate packaged device is shown to comprise chip 26 electrically connected to terminals 41 and 42, the combination to be enclosed within a glass envelope. In order to facilitate packaging in a double-plug glass envelope, the contact placement is readily modified to include the anode contacts on one side of the chip and the cathode contacts on the other side. The spreading-resistance of the contacts remains the primary determinant of total resistance, just as when the contacts are all on the same side.

The curve of FIG. 4 shows the normalized resistance, plotted versus temperature, for a silicon thermistor of the invention. Typically, the silicon chip has a thickness of 14 mils, and a bulk resistivity of about 20 ohm-cm. The backside of the chip is shunted by non-selective doping and metallization, to reduce the bulk-resistivity contribution to total resistance.

The TCR, for example, is about 0.7 percent per degree C., and the resistance range capability is from 100 ohms to 10,000 ohms, over a temperature range of −55°to 125° C.

For silicon, the variation of resistance with temperature, for resistivities greater than about 5 ohm centimeters is approximated by the expression:

$$R = R_{25} \exp[0.0082(T\text{-}25)]$$

where $R$ is the resistance, $R_{25}$ is the resistance at 25° C. and $T$ is the temperature in degrees C.

Although silicon is the preferred resistance material for use in accordance with the invention, it will be apparent that other materials are also useful, including germanium and gallium arsenide, for example.

The advantages of the invention over the prior art include the ability to control dimensional effects with extreme precision by using photolithographic processing, and the ability to obtain a high resistance value in a smaller silicon body than in the conventional prior devices. Consequently, the increased yield of devices having ± 1 percent precision resistance permits a substantial cost-savings.

Since the resistance of the device varies non-linearly with temperature, it may be desirable for some applications to linearize the relationship by the parallel connection therewith of a resistance having a low or zero temperature coefficient. One such embodiment comprises a diffused or implanted p-type resistor in the same chip, connected in parallel with the thermistor.

What is claimed is:

1. A two-terminal resistor comprising a body of resistive material, an insulating film covering said body and having a plurality of apertures therein which define electrical contact areas, a plurality of spreading-resistance thin-film metal contacts to said body in said apertures, at least two of said thin-film contacts being connected in common to constitute a single terminal of said resistor, and at least one of the remaining contacts constituting the other terminal of said resistor.

2. A resistor as in claim 1 wherein said body is doped monocrystalline silicon.

3. A resistor as in claim 1 wherein said body is monocrystalline silicon, and wherein said body further includes a diffused or implanted resistor in prallel electrical connection with said terminals.

4. A resistor as in claim 2 wherein said contacts are aluminum.

* * * * *